US008387812B2

(12) United States Patent
Delage et al.

(10) Patent No.: US 8,387,812 B2
(45) Date of Patent: Mar. 5, 2013

(54) DEVICE FOR SUPPORTING AT LEAST ONE COSMETIC ARTICLE AND ASSOCIATED METHOD OF USE

(75) Inventors: Jean-François Delage, Clamart (FR); Thierry Ramboz, Sannois (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 13/254,768

(22) PCT Filed: Feb. 26, 2010

(86) PCT No.: PCT/EP2010/052491

§ 371 (c)(1), (2), (4) Date: Dec. 7, 2011

(87) PCT Pub. No.: WO2010/100091

PCT Pub. Date: Sep. 10, 2010

(65) Prior Publication Data

US 2012/0085878 A1 Apr. 12, 2012

Related U.S. Application Data

(60) Provisional application No. 61/159,492, filed on Mar. 12, 2009.

(30) Foreign Application Priority Data

Mar. 6, 2009 (FR) ..... 09 51435

(51) Int. Cl.
*B65D 43/18* (2006.01)

(52) U.S. Cl. ..... 220/4.22; 254/824; 254/820; 206/581

(58) Field of Classification Search ..... 16/319, 16/321, 344; 206/581, 214, 371; 220/4.22, 220/4.21, 4.27, 254.4, 824, 820; 132/295, 132/294

See application file for complete search history.

(56) References Cited

U.S. PATENT DOCUMENTS

| | | | | |
|---|---|---|---|---|
| 2,342,477 | A * | 2/1944 | Magnenat | 220/835 |
| 3,583,734 | A * | 6/1971 | Magi | 403/96 |
| 3,811,715 | A * | 5/1974 | Brudy | 403/93 |
| 5,509,332 | A * | 4/1996 | Donaldson, Jr. | 81/59.1 |
| 6,145,515 | A | 11/2000 | Wu | |
| 6,223,921 | B1 | 5/2001 | Huang | |
| 6,302,120 | B1 | 10/2001 | Kuo | |

(Continued)

FOREIGN PATENT DOCUMENTS

EP 1 479 311 11/2004

OTHER PUBLICATIONS

International Search Report issued May 21, 2010 in PCT/EP10/052491 filed Feb. 26, 2010.

*Primary Examiner* — Amy J Sterling

(74) *Attorney, Agent, or Firm* — Novak Druce Connolly Bove + Quigg LLP

(57) ABSTRACT

A device for supporting at least one cosmetic article, and its method of use, including a base, and a body mounted to be movable in rotation about an axis of rotation relative to the base between a retracted position and a deployed position. An articulation assembly including a pivot is fixedly joined to the body and a sleeve for receiving the pivot is fixedly joined to the base. The pivot is mounted to rotate about the axis of rotation in the sleeve. The articulation assembly includes at least one resilient lug fixedly joined to a first of the sleeve or the pivot. The resilient lug is arranged in the intermediate space and has a free end which is pressed against the pivot and is resiliently deformed over at least a portion of the path of the body between the retracted position and the deployed position thereof.

15 Claims, 7 Drawing Sheets

U.S. PATENT DOCUMENTS 6,609,273 B1 * 8/2003 Yamada et al. ..... 16/332
6,725,994 B2 * 4/2004 Bacon ..... 192/223
6,928,700 B2 * 8/2005 Huong ..... 16/342
6,988,630 B2 * 1/2006 Matsumoto ..... 220/254.4
7,451,877 B2 * 11/2008 Koga et al. ..... 206/581
7,461,432 B2 * 12/2008 Lowen et al. ..... 16/334
2002/0179485 A1 12/2002 Shih

* cited by examiner

DEVICE FOR SUPPORTING AT LEAST ONE COSMETIC ARTICLE AND ASSOCIATED METHOD OF USE

The present invention relates to a device for supporting at least one cosmetic article, of the type comprising:

a base;

a body which is mounted so as to be movable in rotation relative to the base about an axis of rotation, between a position retracted and a position deployed relative to the base;

an articulation assembly comprising a pivot which is fixedly joined to one of the base or the body and a sleeve which is for receiving the pivot and which is fixedly joined to the other of the base or the body, the pivot being mounted so as to be able to rotate about the axis of rotation in the sleeve.

The term "cosmetic article" in the context of the present invention is intended to refer, for example, to a cosmetic product which is intended to be applied to a human being as a solid, such as a powder, a liquid, or a cream.

A "cosmetic product" is more generally a product as defined advantageously in the EC Council Directive 93/35 of 14 Jun. 1993.

The term "cosmetic article" is also intended to refer to a tool which is used to directly or indirectly apply a cosmetic product, such as a brush, a fine brush or a mirror.

Such a support device is, for example, a casing which is capable of being received in a handbag.

Casings of the above-mentioned type are known, comprising a base which delimits a reservoir of cosmetic product and a body which is formed by a movable pulling member.

The pulling member is mounted so as to movably rotate relative to the base by means of pivoting between a position retracted in the base and a deployed position remote from the base. It contains, for example, a mirror or tools for applying cosmetic product contained in the base.

The pulling member is generally articulated in the base by means of a pivot which is mounted so as to be fixedly joined to the pulling member and received in a sleeve which is delimited by the base.

Such a device is not entirely satisfactory at least for the following reasons. The articulation between the pulling member and the base must be sufficiently loose to allow pivoting without any significant resistance by the pulling member relative to the base. However, this leads to weak retention of the pulling member in all the intermediate positions between the retracted position and the deployed position, which is neither practical nor aesthetic when the user wishes to keep the pulling member in such an intermediate position.

Furthermore, in order to ensure the vertical retention of the pulling member when it pivots and prevent it from becoming lowered relative to the base, it is necessary to arrange the pulling member above a support wall which is fixedly joined to the base, which increases the thickness of the device and produces an unsatisfactory aesthetic effect when the pulling member is in the deployed position thereof.

An object of the invention is therefore to provide a support device for a cosmetic product comprising a body which can be deployed relative to a base, the device being able to be readily deployed, whilst having a satisfactory aesthetic effect and strength when the body occupies an intermediate position between the retracted position and the deployed position thereof.

To this end, the invention relates to a device of the above-mentioned type, characterised in that the sleeve and the pivot together delimit an intermediate space, the articulation assembly comprising at least one resilient lug which is fixedly joined to a first of the sleeve or the pivot, the resilient lug being arranged in the intermediate space and having a free end which is pressed against a second of the sleeve or the pivot, and is resiliently deformed over at least a portion of the path of the body between the retracted position and the deployed position thereof.

The device according to the invention may comprise one or more of the following features, taken in isolation or according to any technically possible combination:

the free end is pressed against the second of the sleeve or the pivot over substantially the entire path of the body between the retracted position and the deployed position thereof;

the resilient lug comprises a stop for indexing the body in at least one position selected from the retracted position, the deployed position, or an intermediate position between the retracted position and the deployed position, the second of the sleeve or the pivot comprising a complementary stop surface which is capable of co-operating with the indexing stop in order to reversibly block the body relative to the base in the selected position;

the complementary stop surface is formed in a recess which is for receiving the stop and which is provided in the second of the sleeve or the pivot and which opens in the intermediate space;

the resilient lug can be moved relative to the stop surface when the body is rotated relative to the base about the axis of rotation in the same direction between a free first rotation position released from the complementary stop surface, the selected position in which the indexing stop co-operates with the complementary stop surface, and a second free rotation position released from the complementary stop surface;

the articulation assembly comprises at least two resilient lugs, the resilient lugs being arranged at one side and the other of an axial plane which extends through the axis of rotation in order to apply forces which have radial components of an opposite direction to the pivot;

the device comprises a single resilient lug which has at least two points of contact with the pivot, the points of contact being angularly spaced-apart about the axis of rotation;

the pivot protrudes relative to a transverse surface of the one of the base or the body carrying the pivot along a pivot axis, the other of the base or the body having a complementary transverse surface which is pressed against the transverse surface in the retracted position, the angle formed by the axis of the pivot and the transverse surface when the pivot is arranged remote from the sleeve being less than the angle formed by the axis of the pivot and the transverse surface when the pivot is inserted in the sleeve and when the transverse surface is pressed against the complementary transverse surface in the retracted position;

the pivot protrudes relative to a transverse surface of the one of the base or the body carrying the pivot along a pivot axis, the other of the base or the body having a complementary transverse surface which is pressed against the transverse surface in the retracted position, the transverse surface comprising a peripheral region which is intended to be pressed against the complementary transverse surface and a hollow central region which is intended to be placed remote from the complementary transverse surface, the peripheral region occupying less than 5% of the transverse surface;

the articulation assembly comprises means for axially retaining the pivot relative to the sleeve along the axis of rotation, the axial retention means comprising a ring which is fixedly joined to one of the sleeve or the pivot and a retention head which is fixedly joined to the other of the sleeve or the pivot, the retention head being received in the ring, the retention head comprises at least one flexible snap-fitting member which can be radially deformed when the retention head is inserted into the ring with force, the articulation assembly comprises an insert which is attached so as to be fixedly joined to the first of the sleeve or the pivot in the intermediate space between the sleeve and the pivot, the or each resilient lug being formed on the insert;

the resilient lug is integral with the first of the sleeve or the pivot; and the body is located below the base and delimits a lower abutment surface which is capable of being pressed against a support which is independent of the body and the base in the retracted position of the body.

The invention also relates to a method for using a cosmetic article, characterised in that it comprises the following steps:

providing a device as defined above, the body occupying the retracted position thereof;

rotatably moving the body about the axis of rotation between the retracted position and the deployed position thereof, the free end of the resilient lug being pressed against the second of the sleeve or the pivot, and being resiliently deformed over at least a portion of the path of the body between the retracted position and the deployed position thereof.

The invention will be better understood from a reading of the following description, given purely by way of example and with reference to the appended drawings, in which.

Figure 1:
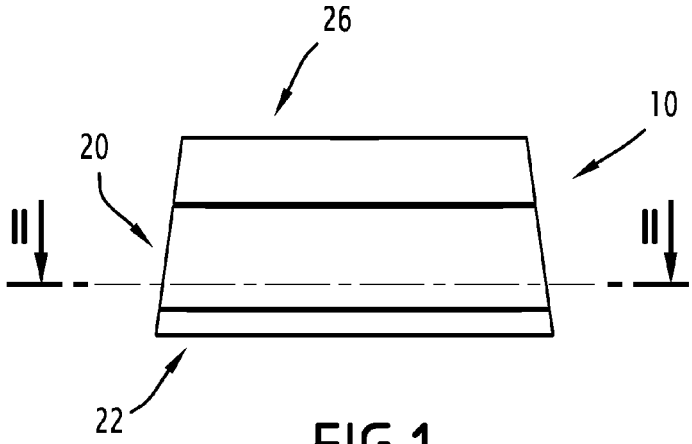
FIG. 1 is a front view of a first support device according to the invention forming a casing containing a cosmetic product.

FIGS. 1 to 10 illustrate a first support device 10 which is formed by a casing which is intended to receive cosmetic articles 12, 14. The articles in this example are a cosmetic product 12 and a tool 14 for applying this cosmetic product to the skin or the keratin fibres of a user.

The cosmetic product 12 is, for example, a solid, such as a powder, a liquid or a cream.

The cosmetic article 14 is, for example, a tool for applying cosmetic product which is intended to be gripped by the user in order to apply the cosmetic product, such as a sponge or a movable applicator or is a tool which is intended to facilitate application of cosmetic product to the user, such as a mirror.

Figure 2:
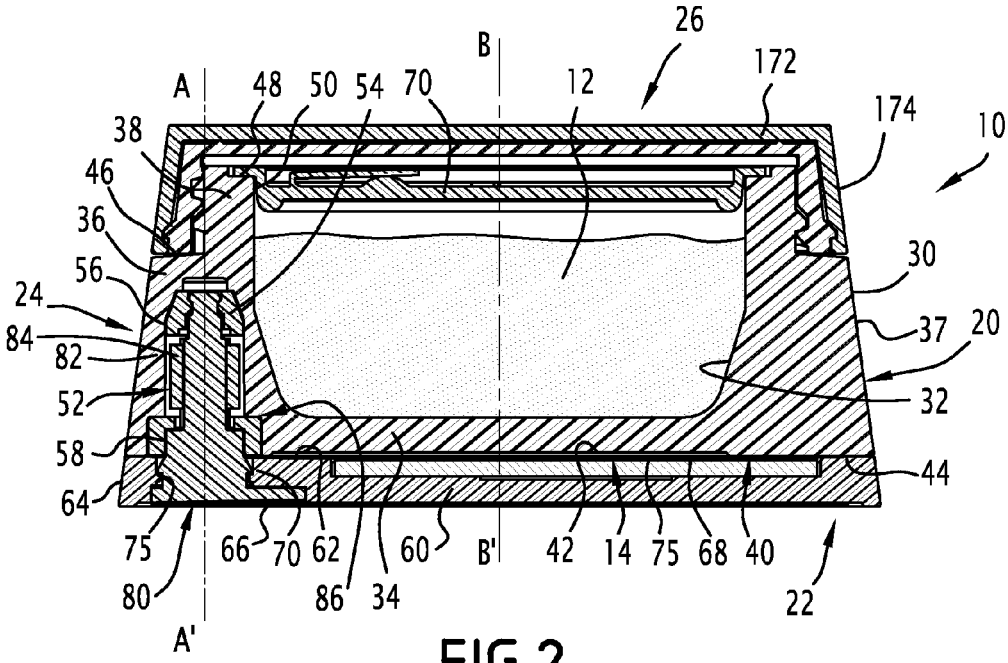
FIG. 2 is a section taken along a vertical centre plane of the device of FIG. 1, the body occupying a retracted position below the base.
Figure 3:
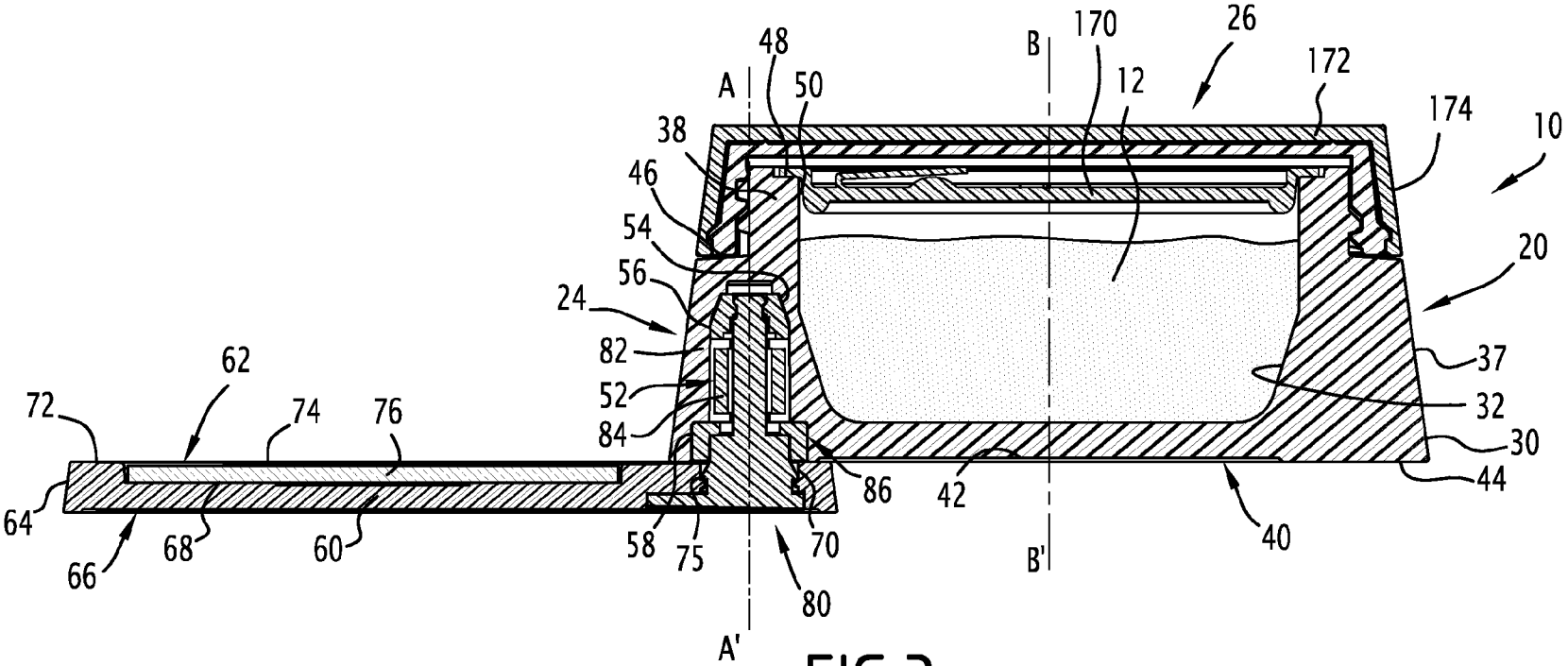
FIG. 3 is a view similar to FIG. 2, the body having been pivoted relative to the base in order to occupy a deployed position.

With reference to FIGS. 1 and 2, the support device 10 comprises a base 20, and a deployable body 22 which is articulated to the body 20 about an articulation axis A-A' which is illustrated as being vertical in FIG. 2, between a retracted position illustrated in FIG. 2, and a deployed position, illustrated in FIG. 3.

The support device 10 further comprises an articulation assembly 24 according to the invention, which will be described in detail below and an assembly 26 for blocking the base 20.

The base 20 is formed by a hollow cup 30 which delimits a compartment 32 for receiving cosmetic product 12.

The cup 30 comprises a base wall 34 which is intended to be pressed against the deployable body 22, a lateral wall 36 and a neck 38 for access to the reservoir 32, the neck 38 being capable of receiving the blocking assembly 26.

The base wall 34 defines a lower surface 40 for abutment against the body 22 that is transverse relative to the axis A-A'.

The lower surface 40 delimits a basin 42 which opens towards the body 22 and a peripheral edge 44 for abutment against the body 22 that is arranged at the periphery of the basin 42.

The lateral wall 36 has an outer peripheral surface 37 which is substantially frustoconical in this example. It delimits with the neck 38 an outer peripheral shoulder 46 for supporting the blocking assembly 26.

The neck 38 protrudes upwards from the outer shoulder 46. It defines an inner peripheral support shoulder 48 and an opening 50 for access to the reservoir 32 which opens upwards, opposite the blocking assembly 26.

The reservoir 32 is delimited downwards by the base wall 34 and is delimited laterally by the lateral wall 36 and the neck 38. It opens outwards via the access opening 50.

The base wall 34 and the lateral wall 36 delimit an axial housing 52 for insertion of the articulation assembly 24 extending along the axis A-A' and being offset transversely relative to a centre axis B-B' of the device.

The axial housing 52 opens downwards via the edge 44 of the lower surface 40.

It has, from top to bottom in FIG. 2, an upper portion 54 which converges partially upwards, an intermediate portion 56 which is substantially cylindrical and a lower portion 58 which has a larger diameter than the intermediate portion 56 which opens in the lower surface 40.

The intermediate portion 56 has two lateral extensions 56A in the form of notches, for mounting the articulation assembly 24, as will be seen below.

The body 22 is formed by a pulling member or plate 60 for supporting the cosmetic article 14. It has, in this example, a thickness taken along the axis A-A' less than the thickness of the base 20.

Figure 10:
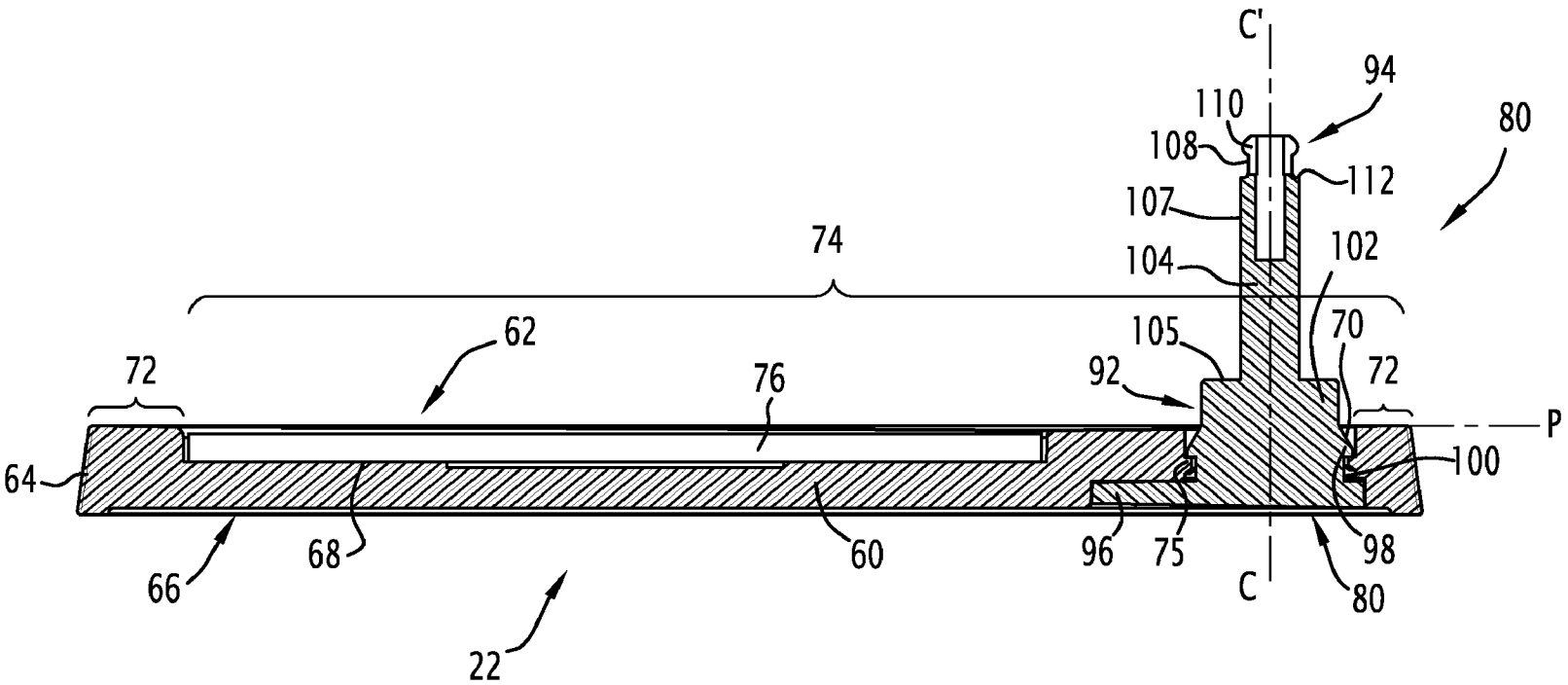
FIG. 10 is a section taken along a vertical centre plane of the deployable body and the articulation pivot which is mounted in the body.

With reference to FIGS. 2, 3 and 10, the plate 60 delimits an upper transverse surface 62 for pressing against the base 20, an outer peripheral surface 64 and a lower surface 66 for abutment on a planar support.

The plate 60 further defines a housing 68 for receiving the cosmetic article 14 and a through-opening 70 for mounting the articulation assembly 24, arranged opposite the axial housing 52.

The plate 60 has an outer contour, taken along the upper surface 62 thereof, which is substantially identical to the outer contour of the base 20, taken along the lower surface 40.

The plate 60 is arranged completely below the lower surface 44 of the base 20. In this manner, the lower surface 66 of the plate 60 is capable of being arranged in abutment against a planar support when the body 22 is in the retracted position thereof, the base 20 being placed completely remote and above the planar support. The thickness of the device 10 can therefore be minimal, since it is not necessary for a portion of the base 20 to be arranged below the body 22.

With reference to FIG. 10, the upper surface 62 has a peripheral region 72 which is pressed against the edge 44 of the lower surface 40 and a central region 74 having a height which is less than the peripheral region 72, which is intended to be placed opposite and remote from the lower surface 40.

The peripheral region 72, taken as a projection in a plane perpendicular relative to the axis A-A', has a surface which is less than 5% of the upper surface 62 taken as a projection in this same plane, which minimises the risk of scratches when the body 22 pivots relative to the base 20.

The housing 68 opens upwards in the upper surface 62. It contains in this example a mirror 76.

The through-opening 70 opens axially upwards opposite the axial housing 52. It also opens downwards. The plate 60 has an annular retention flange 75 which is arranged so as to protrude radially towards the axis A-A' in the opening 70 in order to mount the articulation assembly 24.

As set out above, the body 22 is articulated to the base 20 by means of the articulation assembly 24. It can thus be moved in rotation about the axis A-A' between a retracted position, illustrated in FIG. 2, and a deployed position remote from the base 20, illustrated in FIG. 3, moving through a plurality of intermediate positions along the path thereof between the retracted position and the deployed position.

In the retracted position, the body 22 is arranged below the base 20 so as to be substantially completely covered by the base 20.

In this manner, the peripheral region 72 of the upper surface 62 is pressed against the edge 44 of the lower surface 40. The outer peripheral surface 64 of the body 22 is flush with the outer peripheral surface 37 of the base 20.

The housing 68 for receiving the cosmetic article 14 is blocked in an upward direction by the base wall 34. The cosmetic article 14 is thus inaccessible for the user and is completely covered by the base 20.

The base 20 covers more than 80% of the upper surface 62 of the body 22.

In the deployed position, the body 22 has been pivoted about the axis A-A' relative to the base through an angle greater than 90° and approximately 180° in the example illustrated in FIG. 3.

In this deployed position, only a first portion of the peripheral region 72 around the articulation assembly 24 is pressed against the edge 44. A second portion of this region 72 is arranged transversely remote from the lower surface 40 relative to the axis A-A'.

The housing 68 is offset in an upward direction, which allows the user to access the cosmetic article 14.

The body 22 extends substantially opposite the base 20 relative to a centre plane which extends through the axis A-A'. The base 20 thus covers a fraction of less than 50% of the upper surface 62 of the body 22.

The articulation assembly 24 comprises a pivot 80 which is fixedly joined to the body 22, a sleeve 82 for receiving the pivot which is formed by the walls 34, 36 of the base 20 around the axial housing 52 and, according to the invention, a plurality of urging lugs 84 which are formed in an insert 86 which is attached so as to be fixedly joined in the sleeve 82.

The sleeve 82 is formed by the regions of the base walls 34 and the lateral walls 36 located around the axial housing 52.

Figure 4:
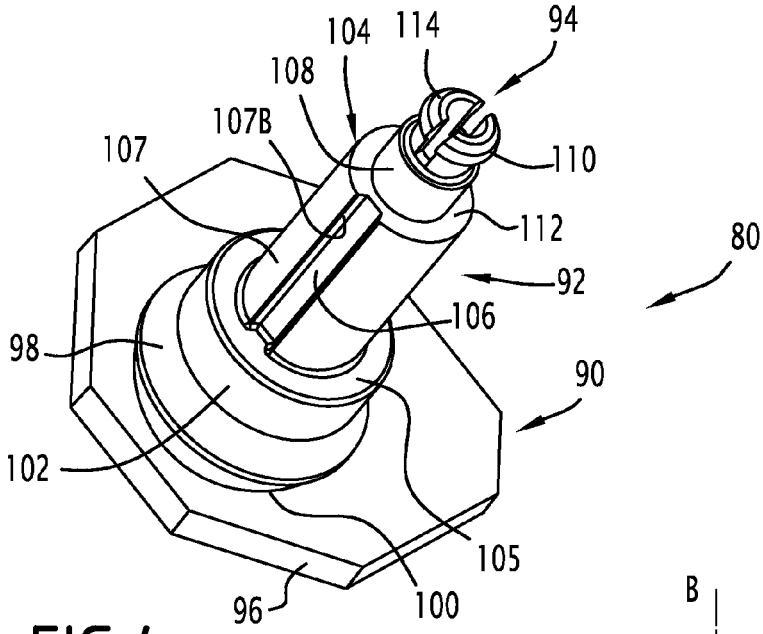
FIG. 4 is a three-quarter front perspective view of the pivot for articulation of the body in the base.
Figure 5:
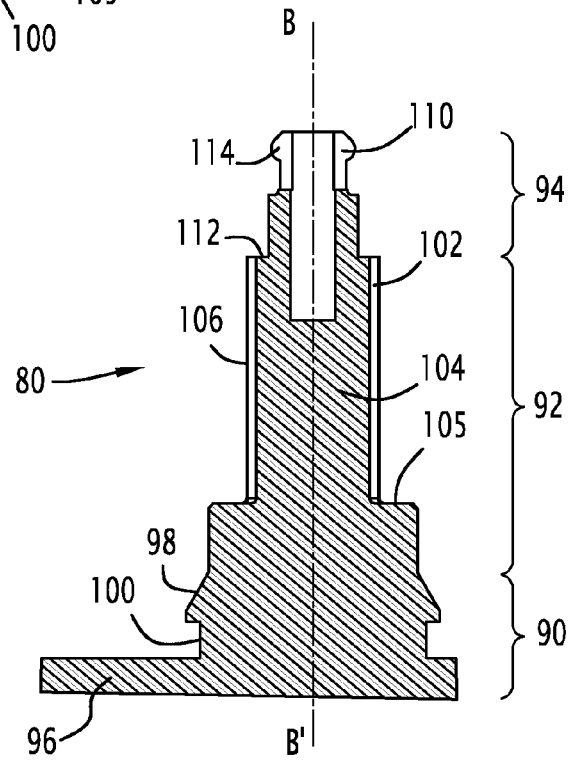
FIG. 5 is a section taken along a vertical centre plane of the pivot of FIG. 4.

The pivot 80 comprises, from bottom to top along a pivot axis C-C' in FIGS. 4 and 5, a lower portion 90 for fixing in the body 22, an intermediate portion 92 for articulation in the base 20, and an upper portion 94 for axially fixing in the base 20.

In this example, the pivot 80 is integral so that the lower portion 90, the intermediate portion 92 and the upper portion 94 are produced in one piece, for example, by means of moulding.

The lower portion 90 of the pivot 80 comprises a base 96 for indexing in the plate 60 and an annular flange 98 which protrudes radially above the base 96 so as to delimit with the base 96 an annular groove 100 for receiving the flange 75.

The lower portion 90 is received in a complementary manner in the through-opening 70. The flange 75 is thus retained by means of force-fitting assembly in the annular groove 100 between the base 96 and the annular flange 98, which fixedly joins the pivot 80 in the body 22.

The intermediate portion 92 protrudes from the through-opening 70 towards the body 22 along the axis C-C'. It comprises a cylindrical base 102 and a pin 104 having a diameter less than that of the base 102 and a height greater than that of the base 102.

The base 102 delimits with the pin 104 a lower shoulder 106 for abutment on the insert 86.

The pin 104 also has a cylindrical shape having an axis C-C'. Externally, it has two axial notches 106 for indexing the body 22 in position relative to the base 20 which opens in a cylindrical peripheral surface 107 of the pin 104.

In this example, the notches 106 are diametrically opposed relative to the axis C-C'. They are delimited by a surface 107B which is radially recessed relative to the cylindrical peripheral surface 107.

The upper portion 94 comprises a head 108 which is provided with snap-fitting members 110 in the insert 86 which can be radially deformed towards the axis C-C'.

The head 108 and the snap-fitting members 110 have a diameter less than the diameter of the pin 104. They thus define with the pin 104 an upper shoulder 112 for abutment in the insert 86.

The snap-fitting members 110 extend at one side and the other of two apertures 114 which are located in a centre plane which extends via the axis C-C'. They can be radially deformed towards the axis C-C' when the head 108 is inserted into the insert 86 as will be seen below.

In the example illustrated in FIG. 10, after the pivot 80 is mounted in the body 22 and before the body 22 and the pivot 80 are mounted in the sleeve 82 and the insert 86, the angle a formed by the axis C-C' of the pivot 80, and via the plane which extends through the peripheral regions 72 of the upper surface 62 of the plate 60 is less than the angle formed by the axis C-C' and this plane P after the pivot 80 is mounted in the insert 86 and in the sleeve, along the axis of rotation A-A'. This angle before mounting is, for example, less than the angle after mounting by at least 0.5° or at least 1°. In this manner, the angle $\alpha$ is, for example, 89° before mounting in the base 20 and is 90° after mounting in the base 20.

This allows the peripheral region 72 of the upper surface 62 to be resiliently pushed against the lower surface 40, since the axis C-C' is coaxial with the axis A-A' of the sleeve 82 which forms the axis of rotation after the pivot 80 has been inserted into the insert 86 and into the sleeve 82.

In this manner, the aesthetic appearance of the device 10 is improved, in particular when the body 22 occupies an intermediate position between the retracted position and the deployed position, since the body 22 remains held parallel with the lower surface 40 of the base 20.

Figure 6:
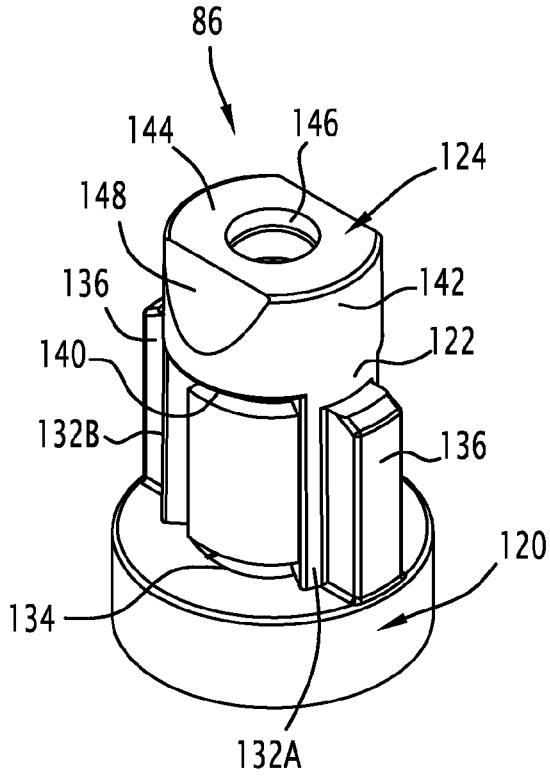
FIG. 6 is a three-quarter front perspective view of the insert arranged between the sleeve and the pivot for articulation of the body on the base.
Figure 7:
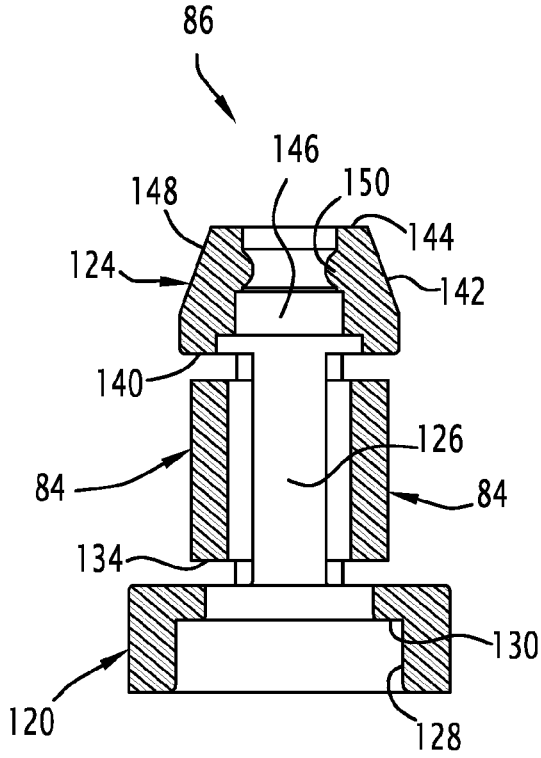
FIG. 7 is a view taken along a vertical centre plane of the insert of FIG. 6.

With reference to FIGS. 6 and 7, the insert 86 comprises a base 120 for rotatably guiding the pivot 80, a wall 122 for supporting the resilient lugs 84 and an upper ring 124 for retaining the head 108. In this example, the insert 86 is integral, the base 120, the support wall 122 and the ring 124 are produced in one piece, for example, by means of moulding.

The base 120, the wall 122 and the upper ring 124 delimit internally a passage 126 for insertion of the pivot 80 having an axis A-A' when the insert 86 is mounted in the sleeve 82.

The guiding base 120 has a shape which substantially complements the lower portion 58 of the axial housing 52.

It defines internally a cylindrical cavity 128 for receiving the cylindrical base 102 of the sleeve 82. The cavity 128 has dimensions which substantially complement those of the base 102. It is delimited upwards by an inner shoulder 130 which co-operates with the lower shoulder 105 on the base 102.

In this manner, the base 102 is rotatably guided about the axis A-A' in the cavity 128 by means of co-operation with the guiding base 120.

Figure 8:
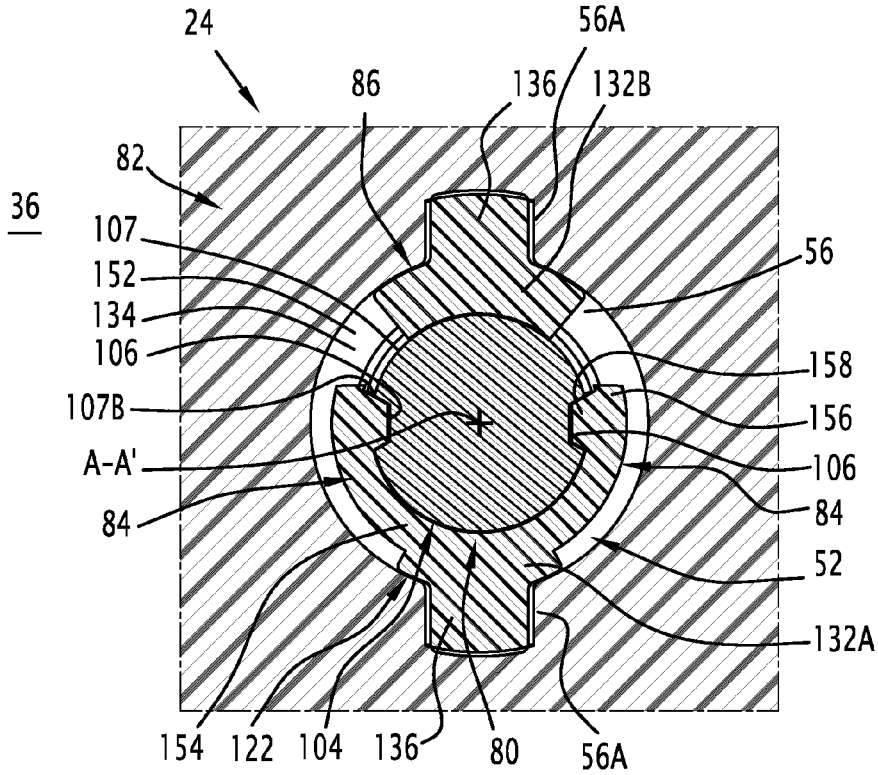
FIG. 8 is a section view taken along a transverse plane of a detail of the articulation elements of the body on the base, the body occupying either the retracted position or the deployed position.

The support wall 122 is generally cylindrical as illustrated in FIGS. 6 and 8. It has two separate support regions 132A, 132B which are located opposite each other and separated from each other by apertures 134.

The support regions 132A, 132B are located diametrically opposed to each other. They extend over an angular extent, taken about the axis A-A', of less than 160° and in particular substantially equal to 90°.

Each region 132A, 132B is extended away from the axis A-A' by a radial rib 136 for blocking the insert in the sleeve 82.

The radial rib 136 extends axially between the guiding base 120 and the ring 124 along the region 132A, 132B parallel with the axis A-A'. It has dimensions, and in particular a width slightly greater than the width of the lateral retention extensions 56A provided in the sleeve 82. In this manner, when the ribs 136 are introduced with force into the lateral extensions 56A, the ribs 136 provide retention axially and in terms of rotation about the axis A-A' of the insert 86 relative to the sleeve 82.

The apertures 134 extend angularly around the axis A-A' between the separate regions 132A, 132B at one side and the other of these regions and are diametrically opposed to each other.

They open transversely in the passage 126. They have an angular extent about the axis A-A' greater than 90° and in particular substantially equal to 120°.

The ring 124 has a lower surface 140 which is connected to the regions 132A, 132B and which delimits in a downward direction the apertures 136, a peripheral outer surface 142 which is intended to be received in the upper portion 54 of the axial housing and an upper surface 144 which is intended to abut against the base of the axial housing 52. It delimits an aperture 146 for inserting the head 108.

The peripheral surface 142 has a shape which is similar to the upper portion 54 of the axial housing 52. It thus delimits flat surfaces 148 which are diametrically opposed and which converge towards the axis A-A' moving towards the base of the housing 52. The flat surfaces 148 are intended to locally increase the thickness of the lateral wall 36 taken between the upper portion 54 of the insertion housing 52 and the reservoir 32 of cosmetic product.

The lower wall 140 and the upper wall 144 extend substantially perpendicularly relative to the axis A-A'. The ring 124 has, in the aperture 146, an axial flange 150 for retaining the snap-fitting lugs 110.

In this manner, when the insert 86 is mounted in the axial housing of the sleeve 82 and the pivot 80 is introduced into the insert 86, the cylindrical base 102 is rotatably received in the cavity 128 with the shoulder 105 arranged in abutment against the inner shoulder 130.

The pin 124 extends in the insertion passage 126 opposite the apertures 134. The pivot 80 thus delimits with the sleeve 82 an intermediate space 152 which is radially offset about the axis A-A' for the insertion of the flexible lugs 84.

The head 108 is received in the aperture 146, the snap-fitting members 110 being engaged above the retention flange 150 in order to provide axial retention of the pivot 80 relative to the sleeve 82.

In this manner, the sleeve 82 and the insert 86 axially retain the pivot 80 relative to the base 20 along the axis A-A'. The pivot 80 is further rotatably mounted about the axis A-A' and is guided in rotation about this axis by the insert 86 which is fixedly joined to the sleeve 82.

According to the invention, the resilient lugs 84 are arranged around the pin 104 in the intermediate space 152 which is delimited between the sleeve 82 and the pivot 80. They protrude into the apertures 134 from a retention region 132A towards the other retention region 132B.

They thus extend in the rest state between a fixed edge on the wall 132A, 132B and a free edge 156 which extends vertically, the free edge 156 being arranged remote from the wall 132A and remote from the wall 132B.

Each resilient lug 84 has a cross-section which is substantially in the form of a circular arc. Each lug 84 comprises, in the region of the free end 156 thereof, a radial indexing stop 158 which protrudes radially towards the axis A-A'. This stop 158 has dimensions which substantially correspond in cross-section to the dimensions of each indexing notch 106 of the pivot 80.

Figure 9:
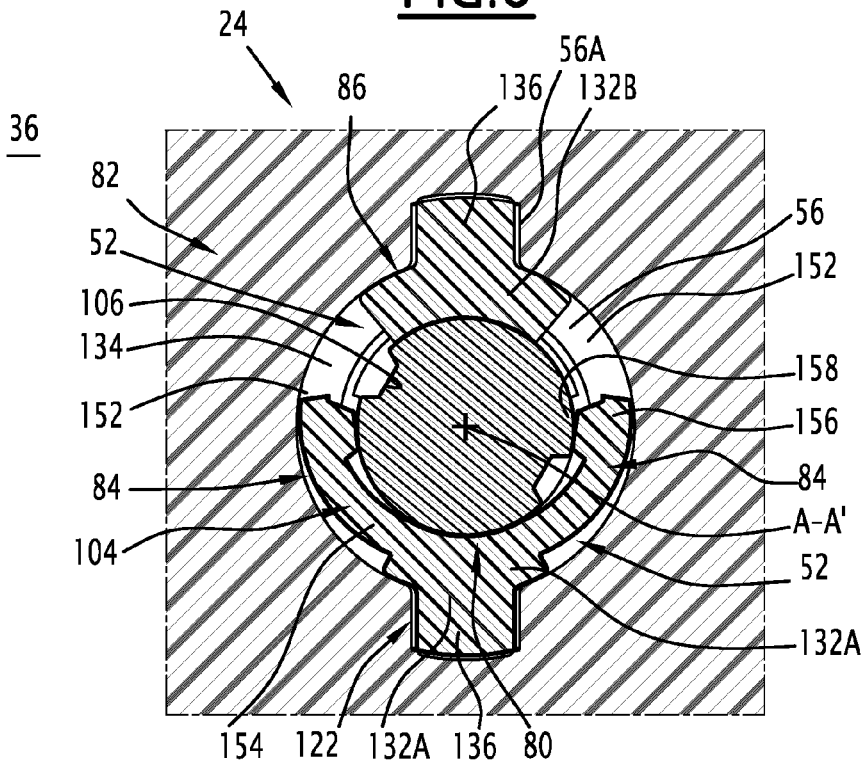
FIG. 9 is a view similar to FIG. 8, the body occupying an intermediate position between the retracted position and the deployed position.

As illustrated in FIGS. 8 and 9, the lugs 84 can be radially deformed away from the axis A-A' between an idle configuration illustrated in FIG. 8 and a resiliently urged deformed configuration illustrated in FIG. 9.

In the idle configuration, the free ends 156 are located relatively closer to the axis A-A' and relatively further away from the sleeve 82. The indexing stops 158 are received in the corresponding notches 106 provided in the pin 104 in order to co-operate with the recessed surface 107B which forms a complementary stop surface.

In the deformed configuration, illustrated in FIG. 9, the stops 158 have been removed from the notches 106. The free ends 156 have been radially displaced away from the axis A-A' towards the sleeve 82. They are pressed against the cylindrical wall 107 of the pin, remote from the notches 104. Each lug 84 thus applies to this wall 107 a radial force which has a component which is directed towards the axis C-C'.

Since the two lugs 84 are located opposite each other, they apply radial forces with opposing radial components, which brings about the clamping of the pin 104 between the free ends 156. This retains the sleeve 82 in an angular position about the axis A-A' in all the intermediate positions of the body 22 relative to the base between the retracted position and the deployed position, without the user having to retain the body.

With reference to FIG. 2, the blocking assembly 26 comprises an inner cover 170 which blocks the reservoir 12 and an outer cover 172 which outwardly blocks the inner cover 170 around the neck 38.

The inner cover 170 is arranged in abutment against the inner shoulder 48. The cover 172 is in this example screwed around the neck 38 and rests in abutment against the shoulder 46. It has a peripheral outer surface 174 which is flush with the outer peripheral surface 37 of the base 20.

The operation of the first support device 10 according to the invention will now be described.

Initially, this device 10 is stored with the body 22 in the retracted position thereof, the inner cover 170 and the cover 172 being mounted on the base.

In this position, and with reference to FIG. 8, the lugs 84 are in the idle position thereof. The indexing stops 158 are inserted in the notches 106, and retain, by means of co-operation with the complementary stop surfaces 107B, the pivot 80 and the body 22 in the retracted position.

In this manner, the body 22 remains held in the retracted position thereof below the base 20, with the upper surface 62 pressed against the lower surface 40 of the base.

When the user wishes to use the cosmetic article 14 located in the deployable body 22, he holds the base 20 between his fingers. Then, he activates the body 22 in order to pivot it about the axis A-A'.

At the beginning of this movement, he overcomes the co-operation force between the stops 158 and the complementary stop surfaces 107B which delimit the notch 106, in order to radially move the free end 156 of the retention lugs 84 away from the axis A-A'. The lugs 84 are resiliently deformed radially outwards.

After the stops 158 have been removed from the notches 106, they remain pressed against the outer cylindrical surface 107 of the pin 104 and apply to this surface a radial force comprising a component directed towards the axis A-A'. In this manner, the pin 104 is clamped between the free ends 154 as described above.

If the user releases the body 22 in an intermediate position between the retracted position and the deployed position, the body 22 remains held in an angular position around the axis A-A' relative to the base 20 by this clamping force. This prevents the body 22 from sliding towards either the retracted or deployed position.

Then, when the body 22 has pivoted through approximately 180°, the stops 158 again penetrate into the notches 106 and abut against the complementary stop surfaces 107B which delimit the notches 106 in order to provide indexing in this position, which can be felt by the user.

It is therefore very easy for a user to reference both the blocking position and the deployed position.

In this deployed position, the cosmetic article 14 formed by the mirror 74 is accessible in order to allow the cosmetic product 12 contained in the reservoir 32 to be readily applied to the skin or the keratin fibres of the user.

When the user has finished using the cosmetic product 12, he can again pivot the body 22 about the axis A-A', either in the same direction as that which allowed him to move it from the retracted position to the deployed position thereof, or in the opposite direction.

In the first instance, the body 22 therefore carries out in total a movement of 360° about the axis of rotation A-A'. The resilient lug 84 can therefore be moved relative to the stop surface 107B when the body 22 is rotated relative to the base 20 about the axis of rotation A-A' in the same direction between a first free rotation position released from the complementary stop surface 107B, the deployed position in which the indexing stop 158 co-operates with the complementary stop surface 107B and a second free rotation position released from the complementary stop surface 107B.

Figure 11:
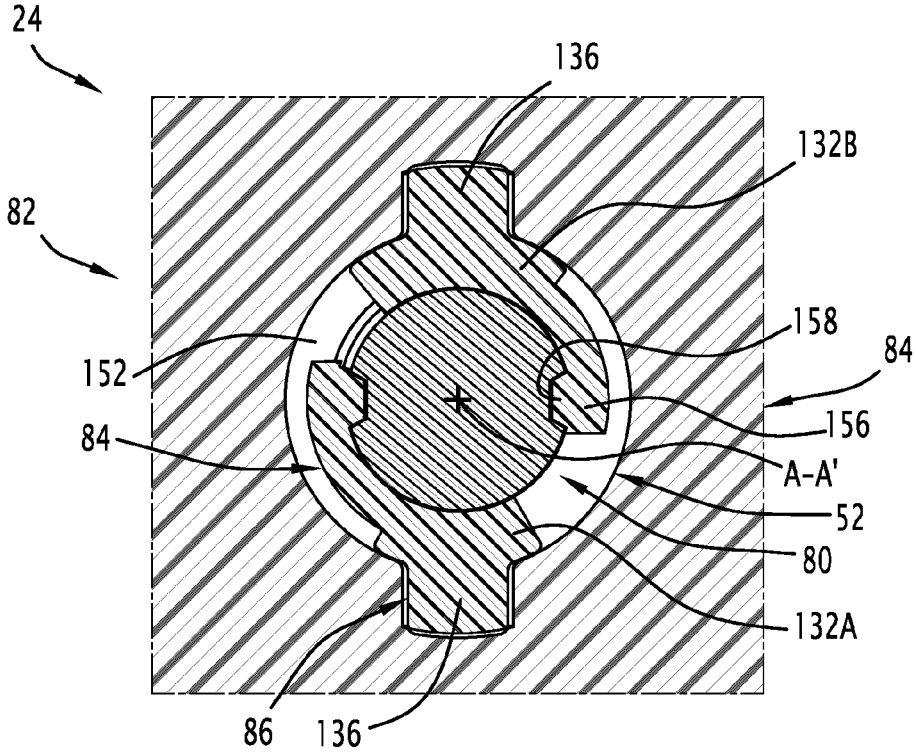
FIG. 11 is a view similar to FIG. 8 of a second device according to the invention.

The relevant parts of the articulation assembly 24 of a second device according to the invention are illustrated in FIG. 11. In contrast to the first device 10, a first resilient lug 84 extends from the first support region 132A, and a second resilient lug 84 extends from the second support region 132B opposite and counter to the first lug 84.

Figure 12:
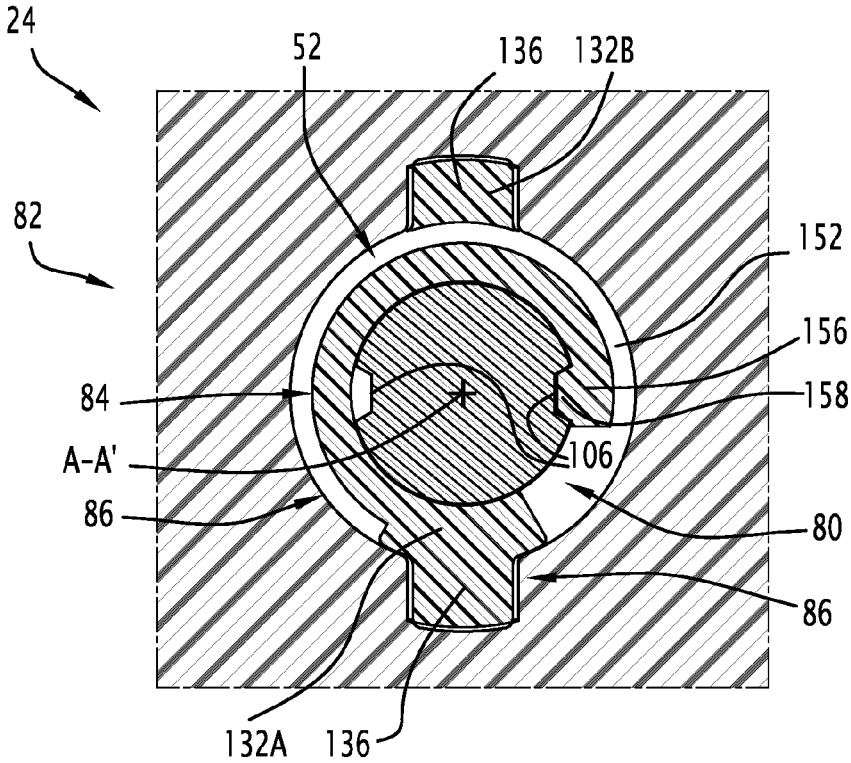
FIG. 12 is a view similar to FIG. 11 of a third device according to the invention.

In the third device according to the invention, illustrated partially in FIG. 12, the articulation assembly 24 comprises a single lug 84 which extends from one of the support regions 132A and which surrounds the pin 102 over an angle greater than 180°, for example, substantially equal to 270°.

The operation of this device is further similar to that of the first device 10.

In a variant, the pivot 80 is fixedly joined to the base 20 whilst the sleeve 82 is provided in the deployable body 22.

In another variant, the resilient lugs 84 are integral with the sleeve 82 which is formed in the lateral wall 36, and no insert is used.

In yet another variant, the resilient lugs 84 are fixedly joined to the pivot 80 and press resiliently on the sleeve 82 or on an insert 86 which is inserted in the sleeve 82.

In other variants, the pivot 80 delimits indexing notches 106 of the body 22 relative to the base 20 which are capable of co-operating with the resilient lugs 84 in at least one selected intermediate position between the retracted position and the deployed position.

The invention claimed is:

1. A device for supporting at least one cosmetic article, comprising: a base; a body mounted to be movable in rotation relative to the base about an axis of rotation, between a position retracted and a position deployed relative to the base; an articulation assembly comprising a pivot fixedly joined to one of the base or the body and a sleeve for receiving the pivot and which is fixedly joined to the other of the base or the body, the pivot being mounted to rotate about the axis of rotation in the sleeve; wherein the sleeve and the pivot together delimit an intermediate space, the articulation assembly comprising at least one resilient lug fixedly joined to one of the sleeve or the pivot, the resilient lug being arranged in the intermediate space and having a free end which is pressed against the other of the sleeve or the pivot, and is resiliently deformed over at least a portion of the path of the body between the retracted position and the deployed position thereof; and wherein the delimits a compartment for receiving a cosmetic product and said body defines a housing for receiving a cosmetic article.

2. A device according to claim 1, wherein the free end is pressed against the other of the sleeve or the pivot over substantially the entire path of the body between the retracted position and the deployed position thereof.

3. A device according to claim 1, wherein the resilient lug comprises a stop for indexing the body in at least one position selected from the retracted position, the deployed position, or an intermediate position between the retracted position and the deployed position, the other of the sleeve or the pivot comprising a complementary stop surface which is capable of co-operating with the indexing stop to reversibly block the body relative to the base in the selected position.

4. A device according to claim 3, wherein the complementary stop surface is formed in a recess which is for receiving the stop and which is provided in the other of the sleeve or the pivot and which opens in the intermediate space.

5. A device according to claim 3, wherein the resilient lug can be moved relative to the stop surface when the body is rotated relative to the base about the axis of rotation in the same direction between a free first rotation position released from the complementary stop surface, the selected position in which the indexing stop co-operates with the complementary stop surface, and a second free rotation position released from the complementary stop surface.

6. A device according to claim 1, wherein the articulation assembly comprises at least two resilient lugs, the resilient lugs being arranged at one side and the other of an axial plane which extends through the axis of rotation to apply forces which have radial components of an opposite direction to the pivot.

7. A device according to claim 1, comprising a single resilient lug which has at least two points of contact with the pivot, the points of contact being angularly spaced-apart about the axis of rotation.

8. A device according to claim 1, wherein the pivot protrudes relative to a transverse surface of the one of the base or the body carrying the pivot along a pivot axis, the other of the base or the body having a complementary transverse surface which is pressed against the transverse surface in the retracted position, the angle formed by the axis of the pivot and the transverse surface when the pivot is arranged remote from the sleeve being less than the angle formed by the axis of the pivot and the transverse surface when the pivot is inserted in the sleeve and when the transverse surface is pressed against the complementary transverse surface in the retracted position.

9. A device according to claim 1, wherein the pivot protrudes relative to a transverse surface of the one of the base or the body carrying the pivot along a pivot axis, the other of the base or the body having a complementary transverse surface which is pressed against the transverse surface in the retracted position, the transverse surface comprising a peripheral region which is intended to be pressed against the complementary transverse surface and a hollow central region which is intended to be placed remote from the complementary transverse surface, the peripheral region occupying less than 5% of the transverse surface.

10. A device according to claim 1, wherein the articulation assembly comprises means axially retaining the pivot relative to the sleeve along the axis of rotation, the axial retention means comprising a ring which is fixedly joined to one of the sleeve or the pivot and a retention head which is fixedly joined to the other of the sleeve or the pivot, the retention head being received in the ring, the retention head comprising at least one flexible snap-fitting member which can be radially deformed when the retention head is inserted into the ring with force.

11. A device according to claim 1, wherein the articulation assembly comprises an insert which is attached so as to be fixedly joined to the first element among the sleeve and the pivot in the intermediate space between the sleeve and the pivot, the or each resilient lug being formed on the insert.

12. A device according to claim 1, wherein the resilient lug is integral with the first element among the sleeve and the pivot.

13. A device according to claim 1, wherein the body is located below the base and delimits a lower abutment surface which is capable of being pressed against a support which is independent of the body and the base in the retracted position of the body.

14. A device according to claim 1, wherein the lugs can be radially deformed away from the axis of rotation between an idle configuration, in which their free ends are located relatively closer to the axis of rotation, and relatively further from the sleeve and a deformed configuration, in which the free ends have been radially displaced from the axis of rotation towards the sleeve.

15. A method for using a cosmetic article, comprising: providing a device for supporting at least one cosmetic article, comprising: a base; a body mounted to be movable in rotation relative to the base about an axis of rotation, between a position retracted and a position deployed relative to the base; an articulation assembly comprising a pivot fixedly joined to one of the base or the body and a sleeve for receiving the pivot and which is fixedly joined to the other of the base or the body, the pivot being mounted to rotate about the axis of rotation in the sleeve; wherein the sleeve and the pivot together delimit an intermediate space, the articulation assembly comprising at least one resilient lug fixedly joined to one of the sleeve or the pivot, the resilient lug being arranged in the intermediate space and having a free end which is pressed against the other of the sleeve or the pivot, and is resiliently deformed over at least a portion of the path of the body between the retracted position and the deployed position thereof; wherein the delimits a compartment for receiving a cosmetic product and said body defines a housing for receiving a cosmetic article; and wherein the body is occupying the retracted position thereof rotatably moving the body about the axis of rotation between the retracted position and the deployed position thereof, the free end of the resilient lug being pressed against the second of the sleeve or the pivot, and being resiliently deformed over at least a portion of the path of the body between the retracted position and the deployed position thereof.

* * * * *